US008613254B2

(12) United States Patent
Lohweg et al.

(10) Patent No.: US 8,613,254 B2
(45) Date of Patent: Dec. 24, 2013

(54) METHOD FOR DETECTION OF OCCURRENCE OF PRINTING ERRORS ON PRINTED SUBSTRATES DURING PROCESSING THEREOF ON A PRINTING PRESS

(75) Inventors: Volker Lohweg, Bielefeld (DE); Johannes Georg Schaede, Würzburg (DE); Thomas Türke, Bielefeld (DE)

(73) Assignee: KBA-Notasys SA, Lausanne (CH)

( * ) Notice: Subject to any disclaimer, the term of this patent is extended or adjusted under 35 U.S.C. 154(b) by 1321 days.

(21) Appl. No.: 12/093,179

(22) PCT Filed: Nov. 21, 2006

(86) PCT No.: PCT/IB2006/054367

§ 371 (c)(1),
(2), (4) Date: Jul. 28, 2008

(87) PCT Pub. No.: WO2007/060615

PCT Pub. Date: May 31, 2007

(65) Prior Publication Data

US 2008/0295724 A1 Dec. 4, 2008

(30) Foreign Application Priority Data

Nov. 25, 2005 (EP) ..... 05111342
Jun. 19, 2006 (EP) ..... 06115689

(51) Int. Cl.
*B41F 33/00* (2006.01)
*B41F 33/14* (2006.01)

(52) U.S. Cl.
USPC ..... 101/483; 101/484

(58) Field of Classification Search
USPC ..... 101/483–485, 211, 248; 382/112
See application file for complete search history.

(56) References Cited

U.S. PATENT DOCUMENTS

| | | | | |
|---|---|---|---|---|
| 3,468,248 | A | 9/1969 | Giori | |
| 3,656,431 | A | 4/1972 | Giori | |
| 4,236,450 | A | 12/1980 | Bonomi | |
| 4,516,496 | A | 5/1985 | Giori | |
| 5,033,378 | A * | 7/1991 | Ebihara | 101/152 |

(Continued)

FOREIGN PATENT DOCUMENTS

| | | |
|---|---|---|
| AU | 611635 | 11/1987 |
| CH | 415 694 | 1/1967 |

(Continued)

*Primary Examiner* — Ren Yan
*Assistant Examiner* — Marissa Ferguson Samreth
(74) *Attorney, Agent, or Firm* — Nixon & Vanderhye P.C.

(57) ABSTRACT

There is described a method for detection of occurrence of printing errors on printed substrates during processing thereof on a printing press comprising the steps of providing multiple sensors on functional components of the printing press to monitor the behavior of the printing press during processing of the printed substrates and performing an in-line analysis of the behavior of the printing press to determine occurrence of a characteristic behavior of the printing press which leads or is likely to lead to occurrence of printing errors on the printed substrates or which leads or is likely to lead to good printing quality of the printed substrates. In-line analysis of the behavior of the printing press preferably includes performing fuzzy pattern classification of the behavior of the printing press. According to one embodiment of the proposed method in-line analysis of the behavior of the printing press is coupled with an in-line optical inspection of the printed substrates.

30 Claims, 9 Drawing Sheets

(56) References Cited

U.S. PATENT DOCUMENTS

| | | | | | |
|---|---|---|---|---|---|
| 5,062,359 | A | | 11/1991 | Giori | |
| 5,317,390 | A | | 5/1994 | Bolza-Schunemann et al. | |
| 5,329,852 | A | | 7/1994 | Bolza-Schuenemann et al. | |
| 5,384,859 | A | | 1/1995 | Bolza-Schunemann et al. | |
| 5,390,598 | A | | 2/1995 | Stauffer | |
| 5,608,639 | A | * | 3/1997 | Twardowski et al. | 700/125 |
| RE35,495 | E | | 4/1997 | Bolza-Schuenemann et al. | |
| 5,724,437 | A | * | 3/1998 | Bucher et al. | 382/112 |
| 5,778,088 | A | | 7/1998 | Stringa | |
| 5,797,321 | A | | 8/1998 | Shibata | |
| 5,835,626 | A | * | 11/1998 | Huber et al. | 382/167 |
| 5,899,145 | A | | 5/1999 | Schaede | |
| 5,974,683 | A | | 11/1999 | Shibata | |
| 6,024,018 | A | * | 2/2000 | Darel et al. | 101/365 |
| 6,111,261 | A | | 8/2000 | Bolza-Schunemann et al. | |
| 6,128,609 | A | * | 10/2000 | Rose | 706/25 |
| 6,192,140 | B1 | | 2/2001 | Reinhard et al. | |
| 6,332,398 | B1 | | 12/2001 | Reinhard et al. | |
| 6,387,214 | B1 | * | 5/2002 | Kustermann et al. | 162/198 |
| 6,401,620 | B1 | * | 6/2002 | Buck et al. | 101/484 |
| 6,499,402 | B1 | * | 12/2002 | Sikes et al. | 101/484 |
| 6,508,172 | B2 | | 1/2003 | Kusaka | |
| 6,598,524 | B2 | | 7/2003 | Reinhard et al. | |
| 6,609,462 | B2 | | 8/2003 | Hauck | |
| 6,662,724 | B2 | | 12/2003 | Reinhard et al. | |
| 6,665,424 | B1 | | 12/2003 | Stringa | |
| 6,705,229 | B2 | | 3/2004 | Frankenberger | |
| 6,746,014 | B2 | | 6/2004 | Endo et al. | |
| 6,772,689 | B2 | | 8/2004 | Endo et al. | |
| 6,796,183 | B2 | * | 9/2004 | Noell | 73/593 |
| 6,822,590 | B2 | | 11/2004 | Kusaka | |
| 6,877,427 | B2 | | 4/2005 | Dunninger et al. | |
| 6,883,429 | B2 | | 4/2005 | Kamoda | |
| 6,901,335 | B2 | * | 5/2005 | Wang et al. | 702/35 |
| 7,000,544 | B2 | | 2/2006 | Riepenhoff | |
| 7,047,881 | B2 | | 5/2006 | Schaede | |
| 7,066,091 | B2 | | 6/2006 | Kumar | |
| 7,477,294 | B2 | | 1/2009 | Lohweg et al. | |
| 7,672,486 | B2 | | 3/2010 | Diederichs et al. | |
| 2001/0027730 | A1 | | 10/2001 | Kamoda | |
| 2001/0054364 | A1 | | 12/2001 | Kusaka | |
| 2002/0035939 | A1 | | 3/2002 | Endo et al. | |
| 2002/0035942 | A1 | | 3/2002 | Reinhard et al. | |
| 2002/0038608 | A1 | | 4/2002 | Reinhard et al. | |
| 2002/0096077 | A1 | | 7/2002 | Frankenberger | |
| 2002/0108516 | A1 | | 8/2002 | Endo et al. | |
| 2003/0005841 | A1 | | 1/2003 | Riepenhoff | |
| 2003/0010242 | A1 | | 1/2003 | Hauck | |
| 2003/0122914 | A1 | | 7/2003 | Kusaka | |
| 2004/0128083 | A1 | | 7/2004 | Wang et al. | |
| 2004/0173113 | A1 | | 9/2004 | Dunninger et al. | |
| 2004/0250722 | A1 | | 12/2004 | Kumar | |
| 2005/0127595 | A1 | | 6/2005 | Hendle et al. | |
| 2005/0146733 | A1 | | 7/2005 | Lohweg et al. | |
| 2005/0199148 | A1 | | 9/2005 | Schaede | |
| 2005/0259869 | A1 | | 11/2005 | Lohweg et al. | |
| 2007/0223789 | A1 | | 9/2007 | Diederichs et al. | |
| 2009/0096156 | A1 | | 4/2009 | Hendle et al. | |

FOREIGN PATENT DOCUMENTS

| | | | | | |
|---|---|---|---|---|---|
| DE | 101 32 266 | | | 1/2002 | B41F 33/14 |
| DE | 101 32 266 | A1 | | 1/2002 | |
| DE | 102 08 285 | A1 | | 9/2003 | |
| DE | 20 2004 018072 | | | 1/2005 | B41F 33/08 |
| EP | 0 091 709 | A1 | | 10/1983 | |
| EP | 0 406 157 | A1 | | 1/1991 | |
| EP | 0 527 285 | A2 | | 2/1993 | |
| EP | 0 527 453 | A1 | | 2/1993 | |
| EP | 0 540 833 | A2 | | 5/1993 | |
| EP | 0 543 281 | A1 | | 5/1993 | |
| EP | 0 622 191 | A1 | | 11/1994 | |
| EP | 0 730 959 | A1 | | 9/1996 | |
| EP | 0 820 864 | A1 | | 1/1998 | |
| EP | 0 820 865 | A1 | | 1/1998 | |
| EP | 0 873 866 | A1 | | 10/1998 | |
| EP | 0 985 531 | A1 | | 3/2000 | |
| EP | 1 142 712 | A1 | | 10/2001 | |
| EP | 1 167 034 | A2 | | 1/2002 | |
| EP | 1 190 855 | A1 | | 3/2002 | |
| EP | 1 231 057 | A1 | | 8/2002 | |
| EP | 1 323 529 | A1 | | 7/2003 | |
| JP | 63-137846 | A | | 6/1988 | |
| JP | 03-264359 | A | | 11/1991 | |
| JP | 04-299147 | A | | 10/1992 | |
| JP | 06-286275 | A | | 10/1994 | |
| JP | 07-164619 | A | | 6/1995 | |
| JP | 11-77978 | A | | 3/1999 | |
| JP | 11-198349 | A | | 7/1999 | |
| JP | 2002-316405 | A | | 10/2002 | |
| JP | 2005-313505 | | * | 11/2005 | B41F 33/14 |
| WO | WO 97/37329 | A1 | | 10/1997 | |
| WO | WO 97/48556 | A1 | | 12/1997 | |
| WO | 9920836 | | * | 4/1999 | D21G 1/00 |
| WO | WO 99/41082 | A1 | | 8/1999 | |
| WO | WO 02/102595 | A1 | | 12/2002 | |
| WO | WO 03/070465 | A1 | | 8/2003 | |
| WO | WO 03/093011 | A1 | | 11/2003 | |
| WO | WO 2004/017034 | A1 | | 2/2004 | |
| WO | WO 2005/104034 | A1 | | 11/2005 | |

* cited by examiner

GOOD SHEET:

SHEET WITH PRINTING ERRORS DUE TO INADEQUATE WIPING PRESSURE:

SHEET WITH PRINTING ERRORS DUE TO WET WIPING CYLINDER SURFACE:

SHEET WITH PRINTING ERRORS DUE TO DIRTY WIPING CYLINDER SURFACE:

METHOD FOR DETECTION OF OCCURRENCE OF PRINTING ERRORS ON PRINTED SUBSTRATES DURING PROCESSING THEREOF ON A PRINTING PRESS

This application is the U.S. national phase of International Application No. PCT/IB2006/054367, filed 21 Nov. 2006, which designated the U.S. and claims priority to European Patent Application Nos. 05111342.1 and 06115689.9, filed 25 Nov. 2005, and 19 Jun. 2006, respectively, the entire contents of each of which are hereby incorporated by reference.

TECHNICAL FIELD

The present invention generally relates to inspection of the quality of printed substrates which are processed on printing presses. More specifically, the present invention relates to in-line inspection of printed substrates, such as printed sheets or webs, i.e. methods for detection of occurrence of printing errors on printed substrates during processing thereof on a printing press. The present invention is in particular directed to detection of occurrence of printing errors on printed substrates for the production of security documents, especially banknotes.

BACKGROUND OF THE INVENTION

During manufacturing of printed products, measures are typically taken to ensure a certain level of printing quality. This is particularly true in the field of security printing where the quality standards that must be reached by the end-products, i.e. banknotes, security documents and the like, are very high. Quality inspection of printed products is conventionally limited to the optical inspection of the printed product. Such optical inspection can be performed as an off-line process, i.e. after the printed products have been processed in the printing press, or, more frequently, as an in-line process, i.e. on the printing press where the printing operation is carried out.

Optical inspection systems which are basically adapted to inspect printed products at large are already available on the market. These inspection systems typically work in the RGB domain based on the to be now designated as classic threshold-based inspection methods. Such inspection methods are for instance disclosed in U.S. Pat. No. 5,384,859 and U.S. Pat. No. 5,317,390. These publications disclose so-called iconic pixel-difference or threshold inspection methods, i.e. inspection methods which are based on the analysis of pixel density differences between sample images of the printed products and reference images. The threshold parameters are usually defined based on a comparison of several master images, whereby mean values or standard deviations are determined in local regions of the images and are attributed corresponding thresholds or tolerances. These values and tolerances are then compared with actual image values measured on sample images of the inspected material.

The above threshold inspection methods exhibit a certain number of disadvantages as described in detail hereinafter. These inspection methods may be adapted for inspection of security documents, but under certain conditions. Threshold-based inspection methods are not directly suited for the inspection of security documents, as security documents are printed using specific printing processes (such as intaglio printing for instance) which are not commonly used in commercial printing. The conventional threshold-based inspection methods must accordingly be adapted to the specific printed features of security documents.

According to the current state of the art, iconic threshold image processing techniques (as described in the above-mentioned U.S. Pat. No. 5,384,859 and U.S. Pat. No. 5,317,390) are normally used because of the high production rates. These methods however have the disadvantage that high, but nevertheless tolerable fluctuations during the production process can lead to detection of pseudo-errors in regions of the inspected images where an abrupt change of contrast is present. In order to prevent such pseudo-errors from occurring, the said regions which are characterized by abrupt changes of contrast are typically rendered insensitive to error detection (i.e. by attributing high tolerances to these regions) so that the inspection process can be stabilized. Error detection in the regions having abrupt changes of contrast is thus made almost impossible.

Other optical inspection methods are known in the art. European patents EP 0 730 959 and EP 0 985 531 for instance disclose inspection methods which are based on "elastic" models which take into account possible deformations of the printed substrates. Perceptive inspection methods which simulate in a rudimental way the perception of the human vision are also known from international application WO 2004/017034 and from German patent application DE 102 08 285. Statistical methods based on a statistical analysis of image patterns are also known in the art but have not shown a sufficiently satisfying performance.

The above optical inspection methods are by definition limited to inspection of the optical quality of the printed products, such as whether too much or too little ink has been applied onto the printed material, whether the density of the applied ink is acceptable, whether the spatial distribution of the applied ink is correct, etc. While these systems are adapted to detect such printing errors in a relatively efficient manner, the known inspection systems are however unable to perform an early detection of progressively-building printing errors. Such printing errors do not occur in an abrupt manner, but rather in a progressive and cumulative manner. These printing errors typically occur because of a gradual degradation or deviation of the behaviour of the printing press. As optical inspection systems inherently exhibit inspection tolerances, printing errors will only be detected after a certain period of time, when the tolerances of the optical inspection system are exceeded.

Experienced printing press operators may be capable of identifying degradation or deviation in the printing press behaviour which could lead to the occurrence of printing errors, for instance based on characteristic noises produced by the printing press. This ability is however highly dependent on the actual experience, know-how and attentiveness of the technical personnel operating the printing press. Furthermore, the ability to detect such changes in the printing press behaviour is intrinsically dependent on personnel fluctuations, such as staff reorganisation, departure or retirement of key personnel, etc. Moreover, as this technical expertise is human-based there is a high risk that this knowledge will be lost over time, the only available remedy consisting in securing storage in one form or another of the relevant technical knowledge and appropriate training of the technical personnel.

SUMMARY OF THE INVENTION

There is therefore a need for an improved inspection system which is not merely restricted to the optical inspection of the printed end-product, but which can take into account other factors than optical quality criteria.

A general aim of the present invention is thus to improve the known inspection techniques and propose an inspection methodology that can ensure a comprehensive control of the quality of the printed substrates processed by printing presses, especially printing presses that are designed to process substrates used in the course of the production of banknotes, security documents and the like.

Additionally, an aim of the present invention is to propose a method that is suited to be implemented as an expert system designed to facilitate operation of the printing press. In this context, it is particularly desired to propose a methodology that can be implemented in an expert system adapted to predict the occurrence of printing errors and/or provide an explanation of the likely cause of printing errors, should these occur.

These aims are achieved by the methods and the expert system defined in the annexed claims. Also claimed is a printing press equipped with the expert system.

Accordingly, there is provided a method for detection of occurrence of printing errors on printed substrates during processing thereof on a printing press comprising the steps of providing multiple sensors on functional components of the printing press to monitor the behaviour of the printing press during processing of the printed substrates and performing an in-line analysis of the behaviour of the printing press to determine occurrence of a characteristic behaviour of the printing press which leads or is likely to lead to occurrence of printing errors on the printed substrates or which leads or is likely to lead to good printing quality of the printed substrates.

In the context of the present invention, the expert system basically comprises the multiple sensors coupled to the functional components of the printing press for monitoring the behaviour of the printing press during processing of the printed substrates, and a processing system coupled to said sensors for performing an in-line analysis of the behaviour of the printing press, which processing system is adapted to carry out the above method.

Advantageously, the above method comprise coupling the in-line analysis of the behaviour of the printing press with an in-line optical inspection of the printed substrates. In-line optical inspection includes (i) optically acquiring images of the printed substrates processed on the printed press, and (ii) processing the acquired images of the printed substrates in order to identify possible occurrence of printing errors on the printed substrates.

According to one embodiment, in-line analysis of the behaviour of the printing press is coupled to in-line optical inspection of the printed substrates in such a way as to issue an early warning of the likely occurrence of printing errors upon determination of a faulty or abnormal behaviour of the printing press while the acquired images are still determined to be devoid of printing errors. In other words, the printing press behaviour is monitored while the printed substrates are optically inspected to check the printing quality thereof and, if a faulty or abnormal printing press behaviour is detected, an early indication of a possible future occurrence of printing errors is provided. Thanks to this embodiment, the early warning of the possible occurrence of printing errors enables a printing press operator to make appropriate changes to the printing press so as to prevent occurrence of the printing errors or limit as much as possible the amount of time between the actual occurrence of the printing errors and the corrective changes to the printing press.

According to another embodiment, in-line analysis of the behaviour of the printing press is coupled to in-line optical inspection of the printed substrates in such a way as to provide an indication of the likely cause of the occurrence of the printing errors. In other words, in case printing errors are detected by the optical inspection system, one or more explanations of the possible cause of the printing errors may be given based on the analysis of the printing press behaviour during processing of the printed substrates.

Analysis of the behaviour of the printing press is preferably performed by modelling characteristic behaviours of the printing press using appropriately located sensors to sense operational parameters of the functional components of the printing press that are exploited as representative parameters of the said characteristic behaviours. These characteristic behaviours comprise:

- faulty or abnormal behaviours of the printing press that lead or are likely to lead to the occurrence of printing errors; and/or
- defined behaviours (or normal behaviours) of the printing press that lead or are likely to lead to good printing quality.

Further, characteristic behaviours of the printing press can be modelled with a view to reduce false errors or pseudo-errors, i.e. errors that are falsely detected by the optical inspection system as mentioned hereinabove, and optimise the so-called alpha and beta errors. Alpha error is understood to be the probability to find bad sheets in a pile of good sheets, while beta error is understood to be the probability to find good sheets in a pile of bad sheets. According to the invention, the use of a multi-sensor arrangement (i.e. a sensing system with multiple measurement channels) efficiently allows to reduce the said alpha and beta errors.

In this case, determination of whether the sensed operational parameters of the functional components of the printing press are indicative of a faulty or abnormal behaviour of the printing press is carried out by monitoring the operational parameters of the functional components of the printing press during processing of the printed substrates on the printing press and by determining whether the monitored operational parameters are indicative of any one of the modelled characteristic behaviours of the printing press.

Modelling of faulty or abnormal behaviours of the printing press preferably includes:

- defining a plurality of classes of printing errors that may occur on the said printing press;
- for each class of printing errors, determining the operational parameters of the printing press that characterize a faulty or abnormal behaviour of the printing press leading or likely to lead to the occurrence of the printing errors; and
- for each class of printing errors, defining a corresponding model of the faulty or abnormal behaviour of the printing press based on the operational parameters that are determined to be characterizing of the said faulty or abnormal behaviour.

In this latter case, determination of whether the sensed operational parameters of the functional components of the printing press are indicative of a faulty or abnormal behaviour of the printing press is carried out by determining whether the monitored operational parameters show a correspondence with any one of the defined models of the faulty or abnormal behaviours of the printing press.

Fuzzy pattern classification techniques are preferably used in order to implement the machine behaviour analysis. In other words, sets of fuzzy-logic rules are used to characterize the behaviours of the printing press and model the various classes of printing errors that are likely to appear on the printing press. Once these fuzzy-logic rules have been defined, these can be applied to monitor the behaviour of the printing press and identify a possible correspondence with any printing press behaviour which is leading or likely to lead to the occurrence of printing errors.

Advantageous embodiments of the invention are the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

EMBODIMENTS OF THE INVENTION

The invention will now be described in the context of a specific embodiment of a sheet-fed intaglio printing press. It will be understood that the invention as defined in the claims is equally applicable to other types of printing presses, in particular offset printing presses. It will also be understood that while the printing press described hereinafter is adapted to process substrates in the form of successive sheets, the invention is also applicable to web-fed printing presses where the substrates to be printed form a continuous web.

Figure 1:
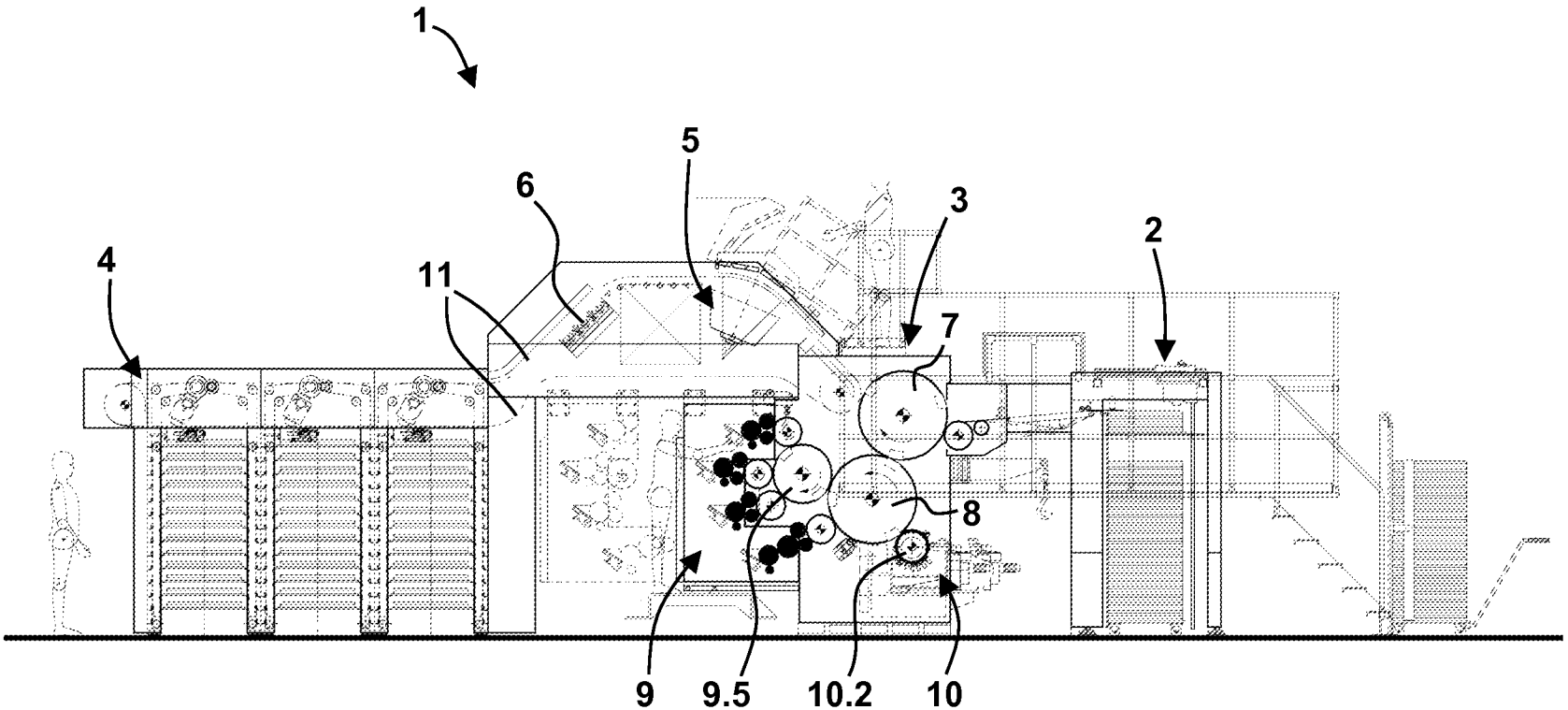
FIG. 1 is a side-view of an intaglio printing press as seen from a drive side.

FIG. 1 shows a sheet-fed printing press in the form of an intaglio printing press 1 comprising, as is usual in the art, a sheet feeder 2 for feeding sheets to be printed, a printing unit 3 for printing the sheets, here by intaglio printing, and a sheet delivery unit 4 for collecting the freshly-printed sheets. The printing unit 3 is adapted for intaglio printing and typically includes an impression cylinder 7, a plate cylinder 8 carrying intaglio printing plates (in this example, the plate cylinder 8 is a three-segment cylinder carrying three intaglio printing plates 8*a*, 8*b*, 8*c*-FIG. 2), an inking system 9 for inking the surface of the intaglio printing plates 8*a*, 8*b*, 8*c* carried by the plate cylinder 8 and a wiping unit 10 for wiping the inked surface of the intaglio printing plates 8*a*, 8*b*, 8*c* carried by the plate cylinder 8 prior to printing of the sheets. Similar examples of intaglio printing presses are disclosed for instance in EP 0 091 709, EP 0 406 157 or EP 0 873 866.

The sheets are fed from the feeder unit 2 onto a feeding table and then onto the impression cylinder 7. The sheets are then carried by the impression cylinder 7 to the printing nip formed by the contact location between the impression cylinder 7 and the plate cylinder 8 where the intaglio printing is performed. Once printed, the sheets are transferred from the impression cylinder 7 to a sheet transporting system 11 in order to be delivered to the delivery unit 4. The sheet transporting system 11 conventionally comprises an endless conveying system with a pair of endless chains driving a plurality of spaced-apart gripper bars for holding a leading edge of the sheets (the freshly-printed side of the sheets being oriented downwards on their way to the delivery unit 4), sheets being successively transferred from the impression cylinder 7 to a corresponding one of the gripper bars.

During their transport to the sheet delivery unit 4, the freshly-printed sheets are preferably inspected by an optical inspection system 5. In the illustrated example, the optical inspection system 5 is advantageously disposed on the path of the sheet transporting system 11, right after the printing unit 3. Such an optical inspection system 5 is already known in the art and does not need to be described in detail. Examples of optical inspection systems adapted for use as optical inspection system 5 in the intaglio printing press of FIG. 1 are for instance described in International applications WO 97/37329 and WO 03/070465. Other examples of optical inspection systems suitable for performing optical inspection of the printed sheets might also be found in EP 0 527 453, EP 0 543 281, WO 97/48556, WO 99/41082, WO 02/102595, EP 0 820 864, EP 0 820 865, EP 1 142 712, EP 1 167 034, EP 1 190 855, EP 1 231 057 and EP 1 323 529.

The optical inspection system 5 is adapted to carry out optical inspection of the printed sheets and detect occurrence of printing errors. As mentioned in the preamble hereof, optical inspection can for instance be carried out according to the principles disclosed in U.S. Pat. Nos. 5,317,390 and 5,384,859 (see also EP 0 527 285 and EP 0 540 833) or any other suitable optical inspection principle.

Before delivery, the printed sheets are preferably transported in front of a drying unit 6 disposed after the inspection system 5 along the transport path of the sheet transporting system 11. Drying could possibly be performed prior to the optical inspection of the sheets.

Depending on the result of the optical inspection, good sheets, i.e. sheets that are considered to be acceptable from the point of view of printing quality following inspection, are delivered to one of two sheet delivery piles (one pile being fed while the other one can be emptied from previously delivered sheets). Bad sheets, i.e. sheets that are not considered to be acceptable form the point of view of printing quality following inspection, are delivered to a third sheet delivery pile.

Figure 2:
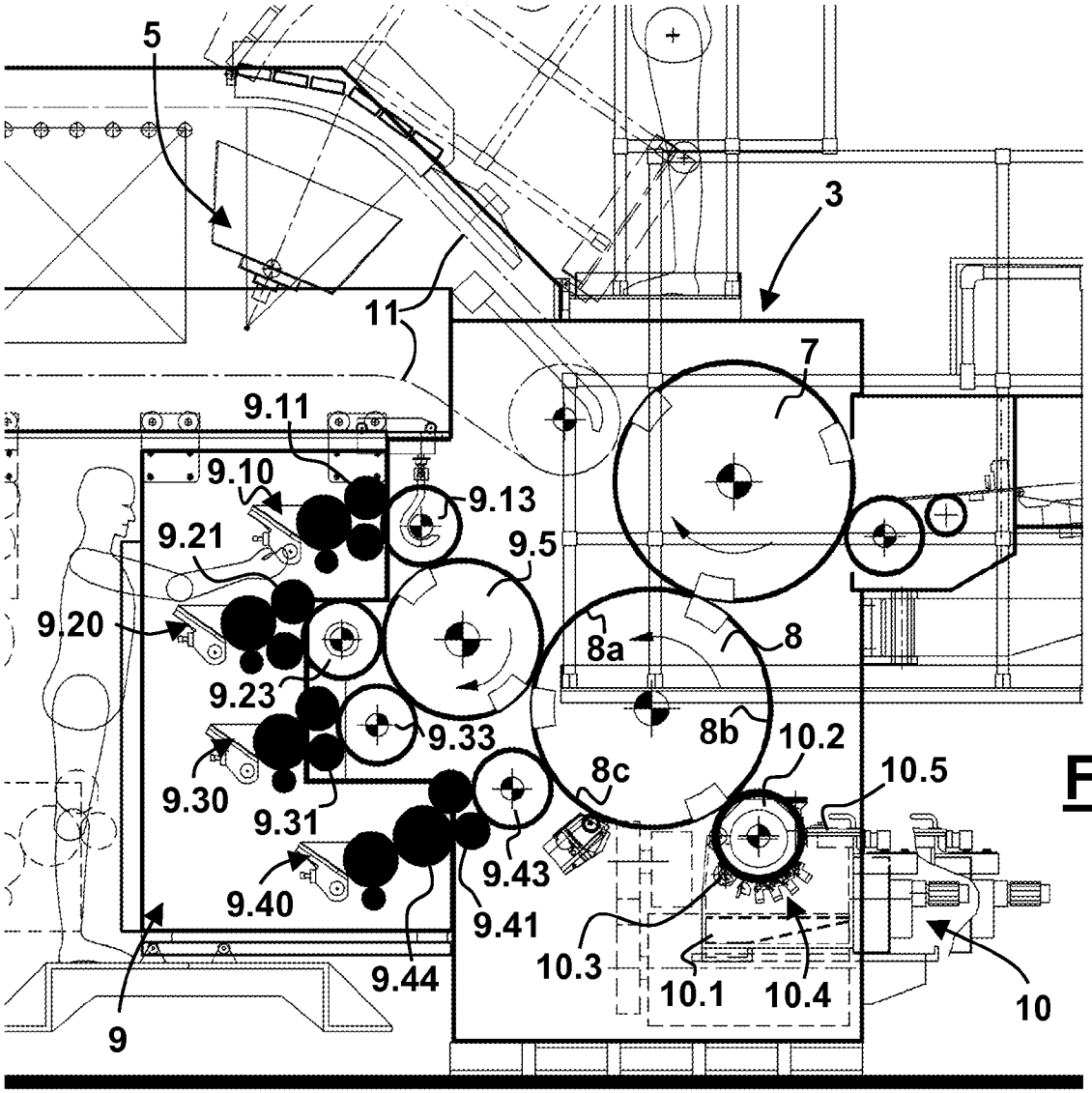
FIG. 2 is an enlarged side view of the printing unit of the intaglio printing press of FIG. 1.

FIG. 2 is a schematic view of the printing unit 3 of the intaglio printing press 1 of FIG. 1. As already mentioned, the printing unit 3 basically includes the impression cylinder 7, the plate cylinder 8 with its intaglio printing plates 8*a*, 8*b*, 8*c*, the inking system 9 and the wiping unit 10.

The inking system 9 comprises in this example four inking devices, three of which cooperate with a common ink-collecting cylinder or Orlof cylinder 9.5 (here a two-segment cylinder) that contacts the plate cylinder 8. The fourth inking device is disposed so as to directly contact the surface of the plate cylinder 8. It will be understood that the illustrated inking system 9 is accordingly adapted for both indirect and direct inking of the plate cylinder 8. The inking devices cooperating with the ink-collecting cylinder 9.5 each include an ink duct 9.10, 9.20, 9.30 cooperating in this example with a pair of inking rollers 9.11, 9.21 and 9.31, respectively. Each pair of inking rollers 9.11, 9.21, 9.31 in turn inks a corresponding chablon cylinder (also designated as selective inking cylinder) 9.13, 9.23, 9.33, respectively, which is in contact with the ink-collecting cylinder 9.5. As for the fourth inking device, it includes an ink duct 9.40, an additional inking roller 9.44, a pair of inking rollers 9.41 and a chablon cylinder 9.43, this latter cylinder being in contact with the plate cylinder 8. The additional ink roller 9.44 is necessary in this latter case as the fourth inking device 9.4 is used to directly ink the surface of the plate cylinder 8 which rotates in opposite direction as compared to the ink collecting cylinder 9.5. As is usual in the art, the surface of the chablon cylinders 9.13, 9.23, 9.33 and 9.43 is structured so as to exhibit raised portions corresponding to the areas of the intaglio printing plates 8*a*, 8*b*, 8*c* intended to receive the inks in the corresponding colours supplied by the respective inking devices.

The wiping unit 10, on the other hand, preferably comprises a wiping tank 10.1 (which is movable towards and away from the plate cylinder 8), a wiping cylinder 10.2 disposed in the wiping tank and contacting the plate cylinder 8, at least a first blade (or dry blade) 10.3 contacting the surface of the wiping cylinder 10.2 for removing wiped ink residues from the surface of the wiping cylinder 10.2, cleaning means 10.4 for applying a wiping solution onto the surface of the wiping cylinder 10.2, and a drying blade 10.5 contacting the surface of the wiping cylinder 10.2 for removing wiping solution residues from the surface of the wiping cylinder 10.2. The cleaning means 10.4 typically include a group of spray devices and cleaning brushes for spraying the wiping solution onto the surface of the wiping cylinder 10.2 and cleaning the surface of the wiping cylinder 10.2.

The first blade or dry blade 10.3 typically removes approximately 80% of the ink residues from the surface of the wiping cylinder 10.2, while the cleaning means 10.4 remove the remaining part of the ink residues under action of the sprayed wiping solution and cleaning brushes. The drying blade 10.5, on the other hand, has the purpose of drying the surface of the wiping cylinder 10.2 and removing wiping solution residues from the surface thereof so as to prevent such wiping solution residues from contaminating the surface of the plate cylinder.

Wiping units of the type comprising spray devices and cleaning brushes as mentioned hereinabove are further described, for instance, in U.S. Pat. No. 4,236,450, EP 0 622 191 and WO 03/093011. Other types of wiping units might be envisaged, such as immersion-type wiping units as described in CH 415 694, U.S. Pat. No. 3,468,248 and U.S. Pat. No. 3,656,431 wherein the wiping cylinder is partly immersed in the wiping solution.

As already mentioned, according to the current state of the art, the printing quality of the printed sheets is typically controlled solely by means of a suitable optical inspection system which is adapted to optically acquire images of the printed sheets and determine, based on a processing of these acquired images, occurrence of printing errors on the printed sheets. As discussed in the preamble hereof, optical inspection of the printed end-product inherently has various problems, in particular is not capable of providing an early warning of the occurrence of printing errors nor an explanation of the likely cause of these printing errors.

According to the present invention, the inherent defects of optical inspection are overcome by performing an in-line analysis of the behaviour of the printing press during the processing of the printed sheets. To this end, the printing press to be monitored is provided with multiple sensors that are disposed on functional components of the printing press. As these sensors are intended to monitor the behaviour of the printing press during processing of the printed substrates, the sensors must be appropriately selected and be disposed on adequate functional components of the printing press. The actual selection of sensors and location thereof on the printing press will depend on the configuration of the printing press one wishes to monitor the behaviour of. These will not be the same, for instance, for an intaglio printing press and for an offset printing press as the behaviours of these machines are not identical.

It is not strictly speaking necessary to provide sensors on each and every functional component of the printing press. Rather, the sensors must be chosen and located in such a way as to sense operational parameters of selected functional components of the printing press that permit a sufficiently precise and representative description of the various behaviours of the printing press. Preferably, the sensors should be selected and positioned in such a way as to sense and monitor operational parameters that are as much uncorrelated to each other as possible. Indeed, the less correlated the operational parameters are, the more precise the definition of the behaviour of the printing press will be. For instance, monitoring the respective rotational speeds of two cylinders that are driven by a common drive will not as such be very useful as the two parameters are directly linked to one another. In contrast, monitoring the current drawn by an electric motor used as a drive means of the printing press and the contact pressure between two cylinders of the printing press will provide a better description of the behaviour of the printing press.

Furthermore, the selection and location of the sensors should be made in view of the actual set of behaviour patterns one desires to monitor and of the classes of printing errors one wishes to detect. As a general rule, it will be appreciated that sensors might be provided on the printing press in order to sense any combination of the following operational parameters:

- processing speed of the printing press, i.e. the speed at which the printing press processes the printed substrates;
- rotational speed of a cylinder or roller of the printing press;
- current drawn by an electric motor driving cylinders of the printing unit of the printing press;
- temperature of a cylinder or roller of the printing press;
- pressure between two cylinders or rollers of the printing press;
- constraints on bearings of a cylinder or roller of the printing press;
- consumption of inks or fluids in the printing press; and/or
- position or presence of the processed substrates in the printing press (this latter information is particularly useful in the context of printing presses comprising several printing plates and/or printing blankets as the printing behaviour changes from one printing plate or blanket to the next).

Depending on the particular configuration of the printing press, it might be useful to monitor other operational parameters. For example, in the case of an intaglio printing press, monitoring of key components of the wiping unit has shown to be particularly useful in order to derive a representative model of the behaviour of the printing press as many printing problems in intaglio printing presses are due to a faulty or abnormal behaviour of the wiping unit.

In the context of the intaglio printing press 1 of FIG. 1, the following operational parameters will thus be considered as a general rule:

- processing speed of the intaglio printing press 1—it will be understood that the behaviour of the intaglio printing press (as for other types of printing presses) will depend on the speed at which it processes the sheets (or webs);
- current drawn by an electrical motor used as driving means of the printing unit 3 of the intaglio printing press 1—again, depending on the behaviour of the printing press, the current drawn by the electrical motor driving the cylinders of the printing unit 3 will vary in a characteristic way;
- rotational speed of the impression cylinder 7, of the plate cylinder 8 and/or of a cylinder or roller of the inking system 9 or of the wiping unit 10 (such as inking rollers 9.11, 9.12, 9.21, 9.22, 9.31, 9.32, 9.41, 9.42, chablon cylinders 9.13, 9.23, 9.33, 9.43, collecting cylinder 9.5 and/or wiping cylinder 10.2)—rotational speed may not be as crucial as other operational parameters of the printing press but could nevertheless constitute useful descriptive information of the behaviour of the printing press;
- temperature of the impression cylinder 7, of the plate cylinder 8 and/or of a cylinder or roller of the inking system 9 or wiping unit 10 (such as inking rollers 9.11, 9.12, 9.21, 9.22, 9.31, 9.32, 9.41, 9.42, chablon cylinders 9.13, 9.23, 9.33, 9.43, collecting cylinder 9.5 and/or wiping cylinder 10.2)—temperature is again a useful operational parameters for describing the machine behaviour; this is particularly true in the case of intaglio printing presses where the plate cylinder 8 is typically thermo-regulated so as to ensure that its temperature is maintained at a substantially constant level (which is typically of the order of 80° C.); a too low temperature of the plate cylinder 8 might for instance cause set-off problems as ink has not started to cure;
- printing pressure between the plate cylinder 8 and the impression cylinder 7—printing pressure is particularly characteristic in intaglio printing, contact pressure typically reaching line pressures of the order of 10 000 N/cm,
- wiping pressure between the plate cylinder 8 and the wiping unit 10—inadequate wiping pressure or variations in the wiping pressure of an intaglio printing press might be the cause of various printing errors; wiping pressure thus constitutes a particularly useful parameters in the context of intaglio printing presses;
- contact pressure between the plate cylinder 8 and the inking system 9 (such as the contact pressure between the ink collecting cylinder 9.5 and the plate cylinder 8 or between the direct chablon cylinder 9.43 and the plate cylinder 8)—as with the printing pressure and the wiping pressure, inadequate contact pressure (or variations thereof) between the plate cylinder and inking system of an intaglio press might be the source of inking problems and therefore printing errors;
- operational parameters of the wiping unit 10—besides the wiping pressure mentioned above, other operational parameters of the wiping unit (as listed hereinafter) appear to be useful to model the printing press behaviour, in particular as far as wiping dysfunctions are concerned; and/or
- operational parameters of the inking system 9—again, besides the contact pressure between the inking system 9 and the plate cylinder 8, operational parameters related to the supply of ink in the inking system 9 (such as the amount of ink in the ink ducts, the amount of ink transferred onto the various inking rollers, the physico-chemical properties of the ink, such as temperature, viscosity, . . . , etc.) might be the source of printing errors.

More particularly, in the context of faulty or abnormal machine behaviours which are due to a dysfunction in the operation of the wiping unit of an intaglio printing press, the following operational parameters will be considered as representative parameters of the printing press behaviour:

- wiping pressure between the wiping cylinder 10.2 and the plate cylinder 8;
- flow of wiping solution in the wiping unit 10;
- physico-chemical properties of the wiping solution (such as temperature of the wiping solution, chemical composition of the wiping solution, etc.);
- blade pressure between the dry blade 10.3 and the wiping cylinder 10.2 or between the drying blade 10.5 and the wiping cylinder 10.2;
- blade position of the dry blade 10.3 or of the drying blade 10.5 with respect to the wiping cylinder 10.2; and/or
- constraints on bearings of the wiping cylinder 10.2.

The above-mentioned lists of operational parameters shall of course be considered as non-exhaustive lists.

The inventors have found that, based on suitable combinations of the above operational parameters, it is possible to model the behaviour of the printing press and identify whether or not the monitored behaviour of the printing press evolves towards an abnormal of faulty behaviour that leads or is likely to lead to the occurrence of printing errors. Accordingly, by performing an in-line analysis of the behaviour of the printing press during printing and/or processing of the substrates it is possible to determine occurrence of a faulty or abnormal behaviour that will or is likely to have an impact on the printing quality of the printed substrates.

Preferably, the proposed in-line analysis of the behaviour of the printing press implies performing a trend analysis of the behaviour of the printing press. In other words, rather than looking at the behaviour of the printing press at a certain point in time, the analysis is performed over a long duration (i.e. during processing of several successive printed substrates). Such trend analysis is preferable in that it permits identification of a gradual deviation or degradation of the behaviour of the printing press.

Preferably, the in-line analysis of the behaviour of the printing press is based on fuzzy pattern classification techniques. Broadly speaking, pattern classification (or recognition) is a known technique that concerns the description or classification of measurements. The idea behind pattern classification is to define the common features or properties among a set of patterns (in this case the various behaviours a printing press can exhibit) and classify them into different predetermined classes according to a determined classification model. More precisely, within the scope of the present invention, the idea is to define a classification model that permits classification of the possible behaviours of a given printing press into different classes of behaviours (or behaviour patterns) corresponding to specific classes of printing errors.

Classic modelling techniques usually try to avoid vague, imprecise or uncertain descriptive rules. Fuzzy systems deliberately make use of such descriptive rules. Rather than following a binary approach wherein patterns are defined by "right" or "wrong" rules, fuzzy systems use relative "if-then"

rules of the type "if parameter alpha is equal to/greater than/less than value beta, then event A always/often/sometimes/never happens". Descriptors "always", "often", "sometimes", "never" in the above exemplary rule are typically designated as "linguistic modifiers" and are used to model the desired pattern in a sense of gradual truth. This leads to simpler, more suitable models which are easier to handle and more familiar to human thinking.

The inventors have identified that fuzzy systems are particularly well suited to the problem of modelling the a priori infinitely-varying behaviour patterns of printing presses. Fuzzy pattern classification in particular is an effective way to describe and classify the printing press behaviours into a limited number of classes. Fuzzy pattern classification typically partitions the input space (in the present instance the variables—or operational parameters—sensed by the multiple sensors provided on functional components of the printing press) into categories or pattern classes and assigns a given pattern to one of those categories. If a pattern does not fit directly within a given category, a so-called "goodness of fit" is reported. By employing fuzzy sets as pattern classes, it is possible to describe the degree to which a pattern belongs to one class or to another. By viewing each category as a fuzzy set and identifying a set of fuzzy "if-then" rules as assignment operators, a direct relationship between the fuzzy set and pattern classification is realized.

Figure 3:
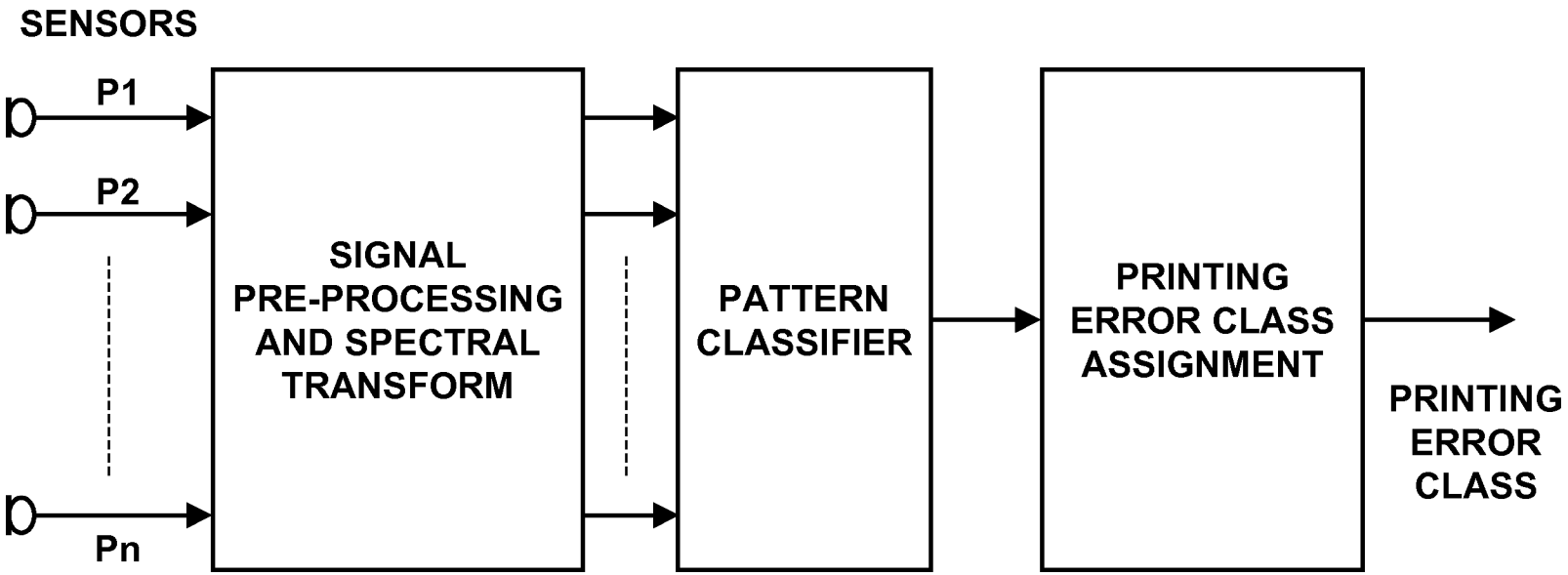
FIG. 3 is a schematic diagram of a fuzzy pattern classification system for performing in-line analysis of the behaviour of the printing press.

FIG. 3 is a schematic view of the architecture of a fuzzy classification system for implementing the printing press behaviour analysis according to the present invention. The operational parameters P1 to Pn sensed by the multiple-sensor arrangement are optionally pre-processed prior to feeding thereof into the pattern classifier. Such pre-processing may in particular include a spectral transformation of some of the signals outputted by the sensors (as explained hereinafter), in particular signals where one expects to find characteristic patterns that are representative of the printing press behaviour. Such spectral transformation will in particular be envisaged for processing the signals representative of vibrations or noises produced by the printing press, such as the characteristic noises/vibrations patterns of intaglio printing presses for instance.

The fuzzy pattern classifier, as already mentioned, is basically implemented as sets of fuzzy "if-then" rules emulating human thinking which are designed to draw links between the printing press behaviour represented by the inputted (and optionally pre-processed) operational parameters P1 to Pn and several determined pattern classes which are each assigned a corresponding class of printing errors. When fed with the monitored operational parameters P1 to Pn provided by the multiple-sensor arrangement, classification is performed into the pre-defined pattern classes and associated classes of printing errors. For each pattern class a corresponding "membership" value or weight (also called "score value" or "goodness of fit value") is preferably attributed in dependence of the correspondence between the monitored printing press behaviour as represented by the inputted operational parameters P1 to Pn and the fuzzy set of rules defining the pattern class.

Various fuzzy models are known as such to those skilled in the art. These include in particular the so-called "Fuzzy Pattern Classification" models (FPC), "Takagi-Sugeno" models and the like. In general, they can be designed with the help of "linguistic" fuzzy rules. Further, output modelling can be designed in different ways, for example using "center of gravity" methods, "Singleton"-based methods, and the like. Within the scope of the present invention, "linguistic" fuzzy modelling techniques and "Singleton"-based output functions appear to be best suited for the purpose of the behaviour classification of the printing press.

Turning back to the example of the intaglio printing press, determined classes of printing errors that can occur on the printing press can be defined. For the sake of explanation, let us list major classes of printing errors than may occur on the intaglio printing press 1 of FIG. 1 and that would be due to dysfunctions in the operation of the wiping unit 10:

class A: printing errors due to insufficient or inadequate wiping pressure between the wiping cylinder 10.2 and the plate cylinder 8—insufficient wiping pressure typically leads to inadequately wiped areas on the surface of the plate cylinder that are then reflected onto the printed substrates as uniformly inked areas;

class B: printing errors due to an insufficiently dried (or too wet) surface of the wiping cylinder 10.2, i.e. because of an improper setting of the drying blade 10.5—a too wet surface of the wiping cylinder typically leads to contamination of the inks on the surface of the plate cylinder which is then reflected onto the printed substrates as inked areas exhibiting diluted or shady areas in the area of the intaglio prints;

class C: printing errors due to a dirty wiping cylinder 10.2, i.e. ink residues remaining on the surface of the wiping cylinder 10.2—a dirty wiping cylinder may be the result of different factors including for instance an insufficient supply or flow of wiping solution (e.g. problems with the spray devices), inefficiency of the cleaning brushes (e.g. excessive wear of the brushes), an inadequate pressure between the dry blade and the wiping cylinder or a damaged dry blade, an inadequate wiping solution temperature, inadequate physical or chemical properties of the wiping solution, etc.—a dirty wiping cylinder typically leads to the occurrence of randomly distributed inked pattern on the printed substrates;

class D: printing errors due to a damaged wiping cylinder 10.2—a damaged wiping cylinder typically causes local variations in the wiping efficiency of the wiping unit over each rotation cycle of the wiping cylinder which are then reflected onto the printed substrates in an analogous way as with class A;

class E: printing errors due to a damaged drying blade 10.5—a damaged drying blade typically leads to variations in the dry/wet state of the surface of the wiping cylinder which are then reflected onto the printed substrates in an analogous way as with class B;

class F: printing errors due to a variations in the temperature of the wiping cylinder 10.2—as with classes A and D variations in the temperature of the wiping cylinder result in variations in the size of the wiping cylinder and therefore a varying wiping efficiency that is then reflected onto the printed substrates.

Figure 4:
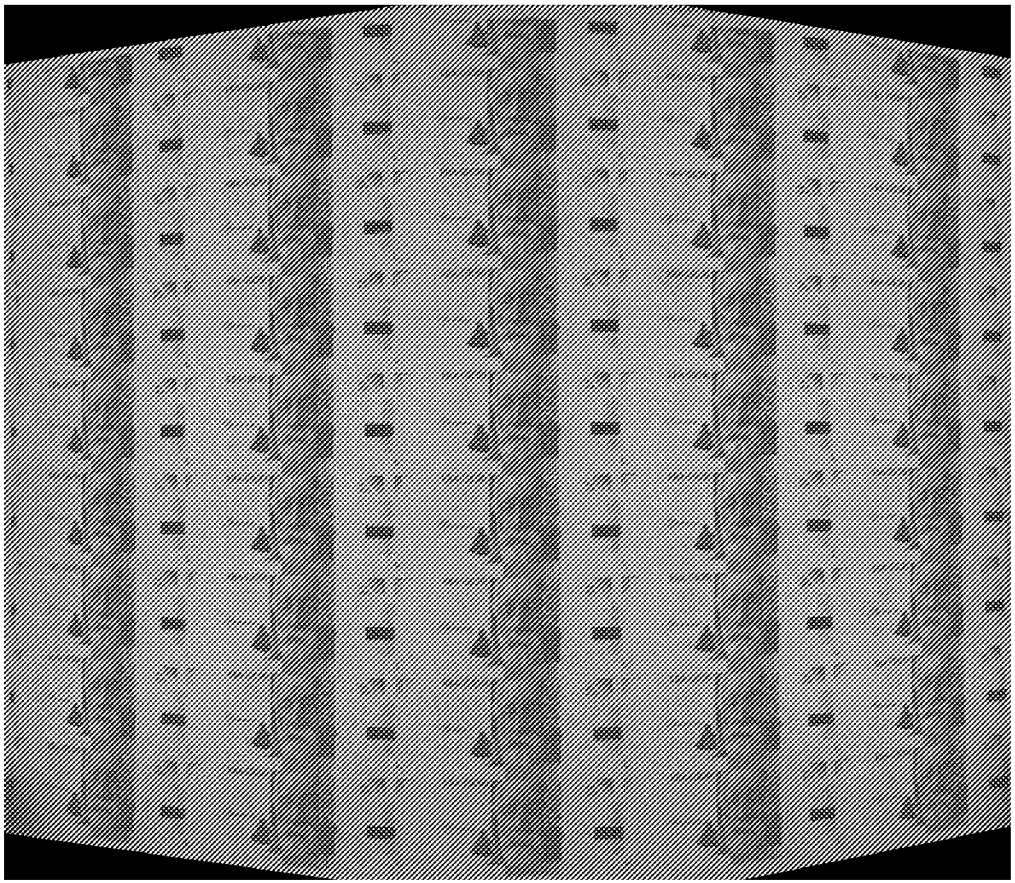
FIG. 4 is an exemplary picture of a printed sheet taken by a camera during processing on the intaglio printing press of FIG. 1, which sheet is considered to be meeting optical quality criteria (i.e. a good sheet)

FIG. 4 is an illustrative partial picture of a printed sheet processed on an intaglio printing press as shown in FIG. 1. More precisely, FIG. A shows a picture of a printed sheet obtained under normal operating conditions.

Figure 4A:
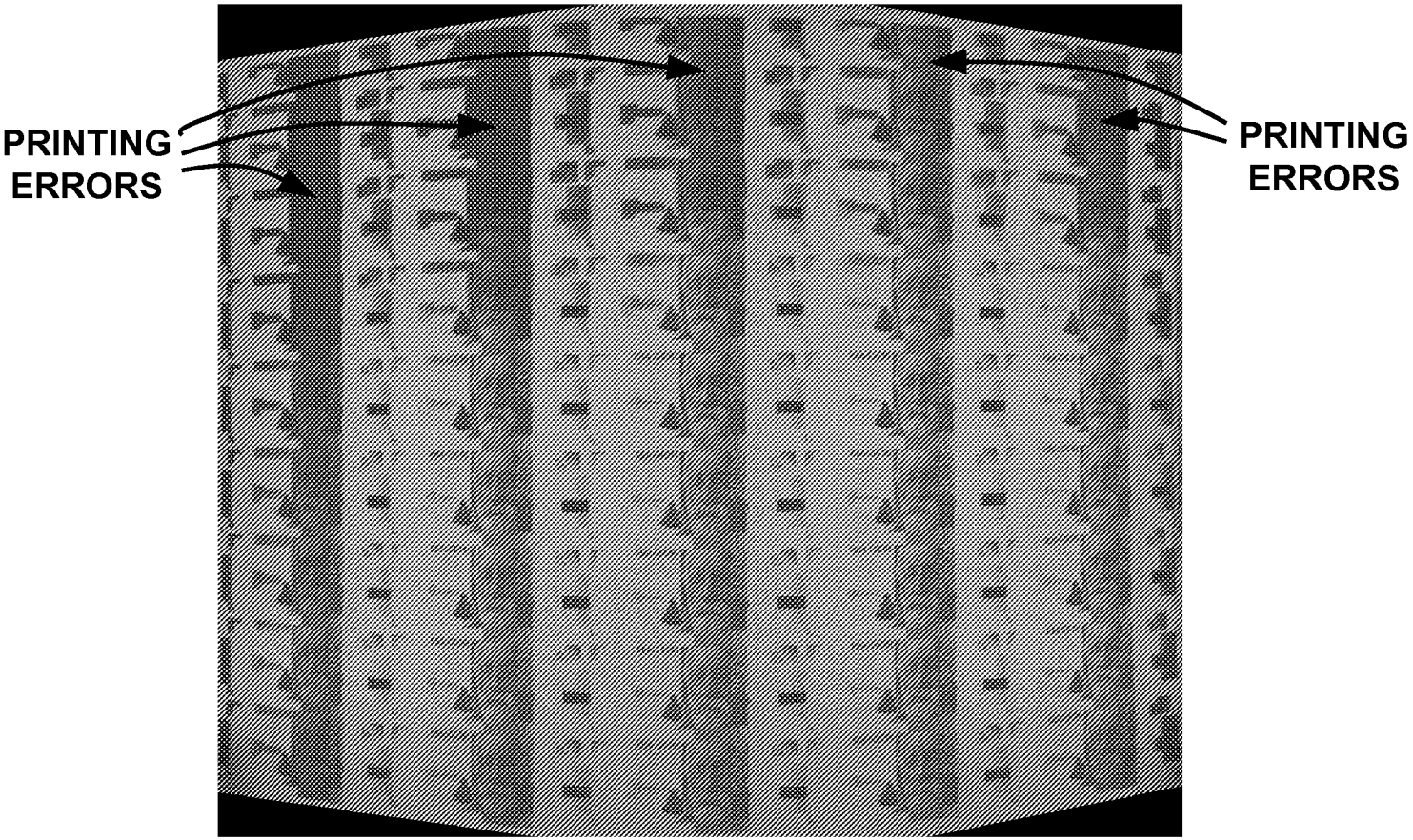
FIG. 4A is a second exemplary picture of a printed sheet taken by a camera during processing on the intaglio printing press of FIG. 1, which sheet contains printing errors due to an inadequate wiping pressure.

FIG. 4A is an illustrative partial picture of a printed sheet processed on the intaglio printing press that exhibits characterizing printing errors due to an inadequate wiping pressure as mentioned under class A hereinabove. As shown in the upper part of FIG. 4A, the printing errors appear as uniformly inked areas in the regions of the intaglio prints. The inventors have identified that the actual occurrence of the printing errors shown in FIG. 4A is not instantaneous, but rather that these printing errors occur after a certain period following decrease of the wiping pressure. By monitoring the current drawn by the electric motor typically driving the printing unit, it is possible to detect a decrease in the wiping pressure, such decrease of wiping pressure being reflected as a decrease in the current consumption. Associated with a monitoring of the constraints (e.g. vibrations) detected on the bearings of the wiping cylinder, it is possible to define a characteristic model of the faulty behaviour of the printing and predict the occurrence of the printing errors. Variations of wiping pressure as mentioned under classes D and F may be detected in a similar way.

Figure 4B:
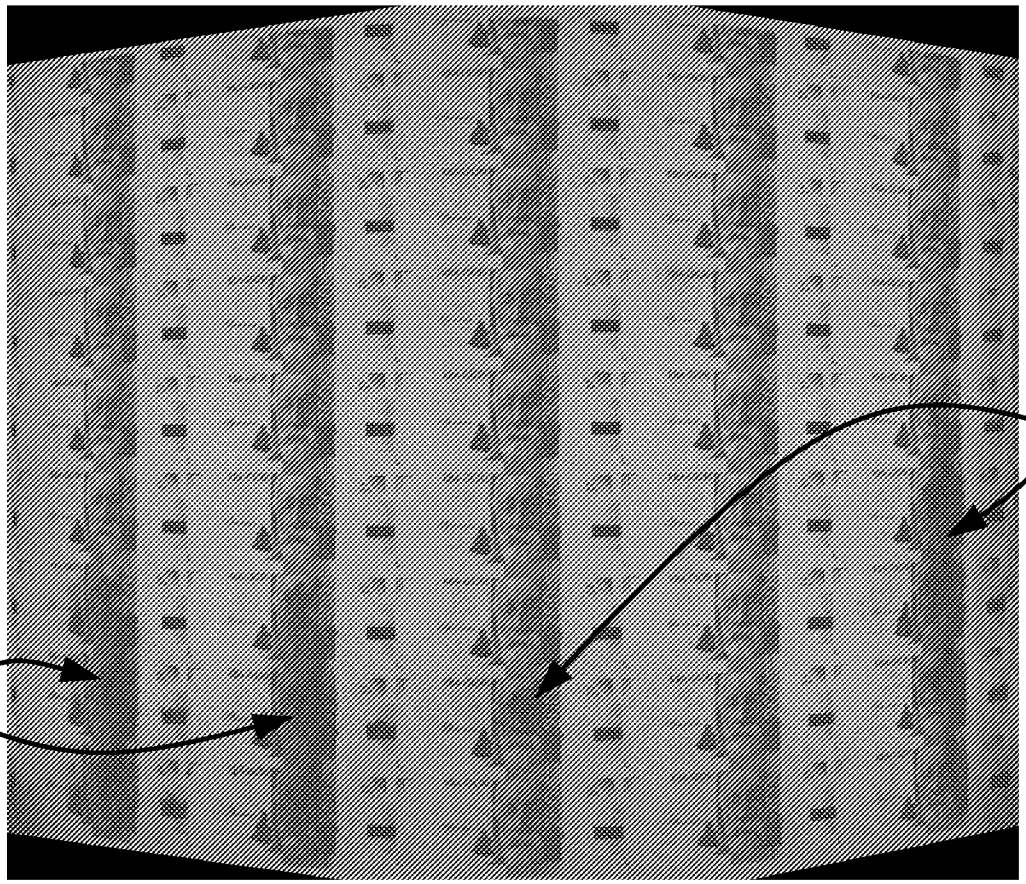
FIG. 4B is a third exemplary picture of a printed sheet taken by a camera during processing on the intaglio printing press of FIG. 1, which sheet contains printing errors due to a wet wiping cylinder surface.

FIG. 4B is an illustrative partial picture of a printed sheet processed on the intaglio printing press that exhibits characterizing printing errors due to contamination with wiping solution as mentioned under class B hereinabove. As shown in the lower part of FIG. 4B, the printing errors appear as diluted or shady areas in the regions of the intaglio prints. The inventors have identified that the actual occurrence of the printing errors shown in FIG. 4B is again not instantaneous, as wiping solution will usually only gradually build up on the intaglio printing plates due to insufficient drying of the wiping cylinder. Again, by monitoring the current drawn by the electric motor driving the printing unit, as well as by monitoring the position of the drying blade and the blade pressure between the drying blade and the wiping cylinder, it is possible to detect occurrence of an insufficient drying of the wiping cylinder surface (such monitoring could alternately or additionally be performed by monitoring directly the surface of the wiping cylinder). A monitoring of the constraints detected on the bearings of the wiping cylinder can again be useful to characterize the behaviour of the printing press related to an insufficient drying. It is thus similarly possible to define a characteristic model of the faulty behaviour of the printing and predict the occurrence of the printing errors. A damaged drying blade as mentioned under class E may be detected in a similar way.

Figure 4C:
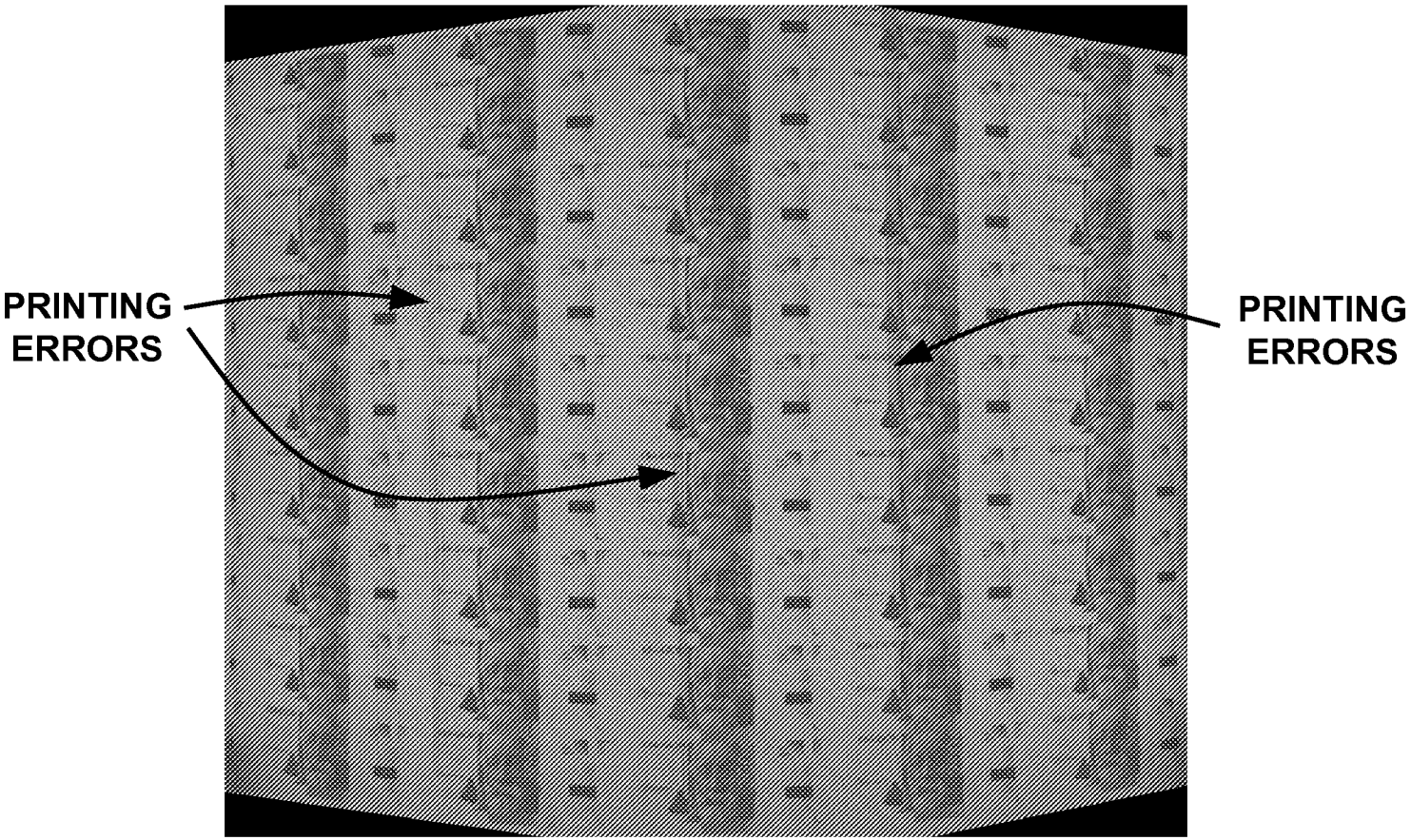
FIG. 4C is a fourth exemplary picture of a printed sheet taken by a camera during processing on the intaglio printing press of FIG. 1, which sheet contains printing errors due to a dirty wiping cylinder surface.

FIG. 4C is an illustrative partial picture of a printed sheet processed on the intaglio printing press that exhibits characterizing printing errors due to a dirty wiping cylinder surface as mentioned under class C hereinabove caused by an insufficient supply of wiping solution. As shown on the left-hand side of the portrait areas visible of FIG. 4C, the printing errors appear as randomly-shaped inked areas. As with the other printing errors, the inventors have identified that the actual occurrence of the printing errors shown in FIG. 4C is again not instantaneous. By monitoring the current drawn by the electric motor driving the printing unit, it is for instance possible to detect a too low amount of wiping solution as the electrical consumption will have a tendency to rise. This measurement can be supplemented with a measurement of the flow of wiping solution. It is thus again possible to define a characteristic model of the faulty behaviour of the printing and predict the occurrence of the printing errors. The other causes of the printing errors mentioned under class C might be monitored in a similar way.

The classes of printing errors listed hereinabove are of course mentioned for the purpose of explanation only. While the above list may be considered as representative of major errors occurring as a consequence of wiping problems, it shall however be understood that this list is not to be considered as exhaustive.

It shall further be understood that printing errors not only occur as a consequence of problems related to the operation of the wiping unit, but that errors might also be the consequence of a dysfunction of other functional components of the printing press, such as for instance an inadequate printing pressure between the plate cylinder 8 and the impression cylinder 7, an inadequate inking of the plate cylinder 8 by the inking system 9, etc.

As already mentioned hereinabove, the analysis of the behaviour of the printing press rests on the provision of an adequate multi-sensor arrangement which is adapted to provide measurements of operational parameters of functional components of the printing press that are sufficiently descriptive of the behaviour of the printing press. One particularly advantageous way to measure the behaviour of the printing press is to monitor noises or vibrations produced by the printing press. Such noises or vibrations could theoretically be measured at any appropriate location on the printing press. A particularly adapted location is to measure noises or vibrations on the bearings of a cylinder of the printing press. In the context of the intaglio printing press illustrated in FIGS. 1 and 2, one suitable location is the supporting shaft of the wiping cylinder 10.2.

Figure 5A:
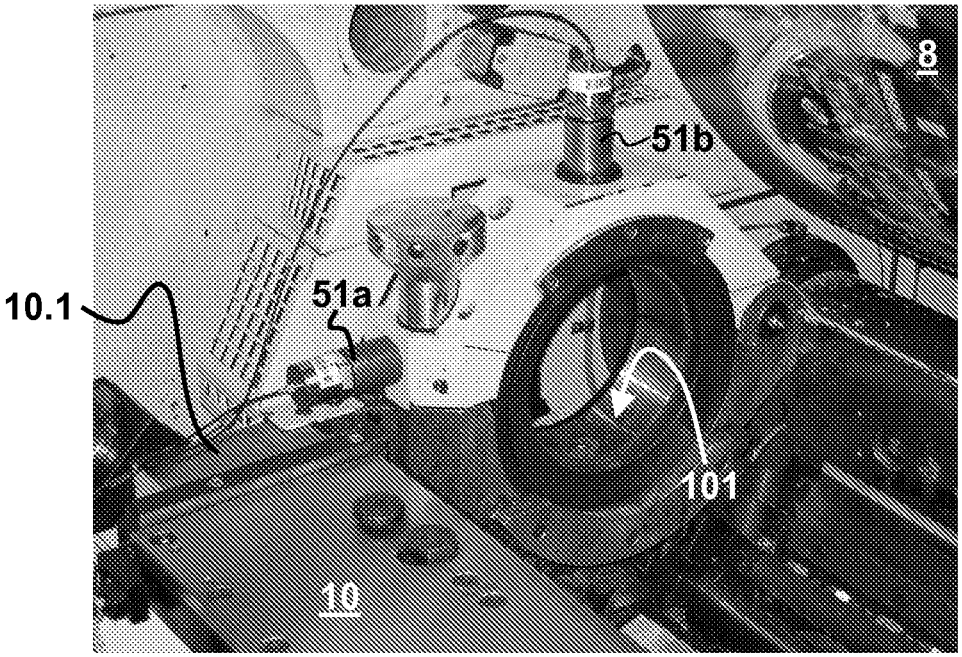
FIGS. 5A and 5B are two photographs of each side of the wiping unit of the intaglio printing press shown in FIGS. 1 and 2, showing the wiping cylinder bearings and a sensor arrangement for detection of noises/vibrations produced by the printing press, which sensor arrangement is disposed on each bearing of the wiping cylinder.
Figure 5B:
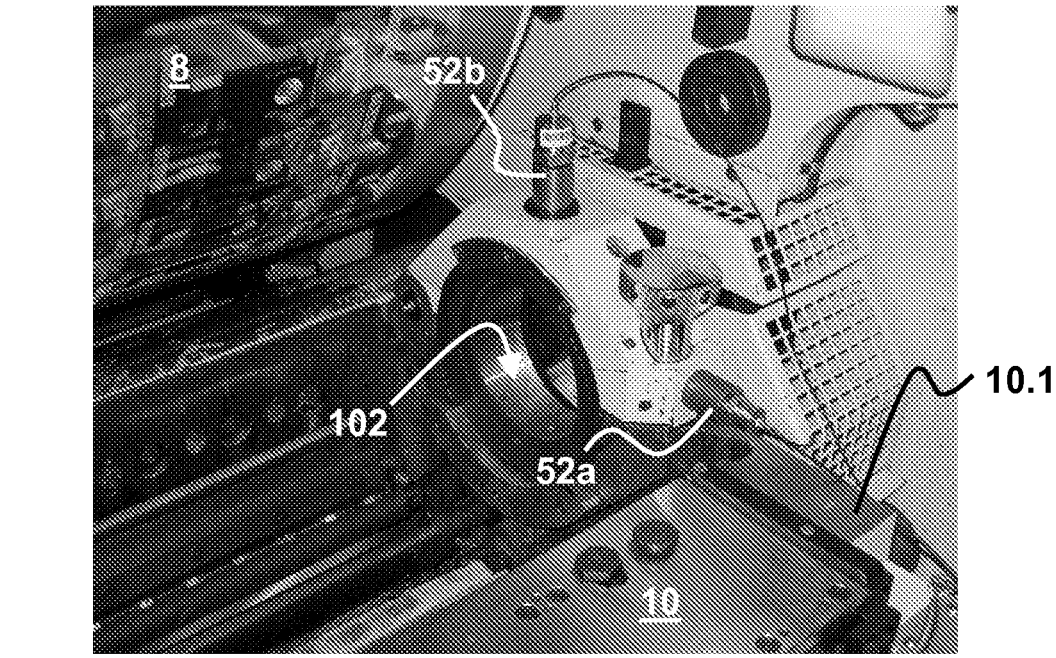

FIGS. 5A and 5B are two photographs of a possible sensor arrangement for sensing noises or vibrations produced by the printing press on the axis of the wiping cylinder 10.2. FIG. 5A shows a first cylinder bearing 101 of the wiping cylinder 10.2 which is located on the wiping tank 10.1 on the left-hand side (or drive side) of the intaglio printing press, while FIG. 5B shows the second opposite cylinder bearing 102 of the wiping cylinder 10.2 (for the sake of clarity FIG. 1 shows the intaglio printing press as seen from its drive side). The wiping cylinder 10.2 is not shown in FIGS. 5A and 5B but would be supported between the two bearings 101 and 102 shown in the photographs. The plate cylinder 8 is partly visible in FIGS. 5A and 5B.

On each cylinder bearing 101, 102, there is preferably provided a pair of sensors 51*a*, 51*b* and 52*a*, 52*b* for sensing the noises or vibrations transmitted along two distinct directions perpendicular to the axis of rotation of the wiping cylinder 10.2, in this case horizontally by means of sensors 51*a*, 52*a* as well as vertically by means of sensors 51*b*, 52*b*. The sensors 51*a*, 51*b*, 52*a*, 52*b* may be any suitable sensors sensitive to noises or vibrations, such as acoustic sensors, acceleration sensors or any other pressure-sensitive or vibration-sensitive sensors.

Using the sensor arrangement shown in FIGS. 5A and 5B, one will thus understand that four measurement channels are provided to monitor the behaviour of the printing press from the point of view of noises or vibrations transmitted to the wiping cylinder 10.2. As already mentioned, these measurement channels would be supplemented by other measurement channels. It was for instance found to be suitable to supplement the above four measurement channels by the following additional channels:

- one channel for the measurement of the processing speed of the printing press (e.g. the number of sheets processed per hour);
- one channel for the current consumption of the motor driving the cylinders of the printing press;
- two channels for the measurement of the printing pressure between the impression cylinder 7 and the plate cylinder 8, pressure being measured at both sides of the cylinders;
- one channel for the measurement of the blade pressure between the drying blade 10.5 and the wiping cylinder 10.2 (which pressure is typically adjusted by hydraulic means);
- one channel for the measurement of the flow of wiping solution;
- two channels for the measurement of the position of the drying blade 10.5, which position is measured at both sides of the blade;
- one channel for the indication of the presence or absence of a sheet at the printing location; and
- one channel for the indication of which printing plate was used to print the sheet.

The above example of a multi-sensor arrangement for sensing the behaviour of the printing press provides as much as fourteen distinct channels which were found to be sufficient for appropriately describing and monitoring the behaviour of the intaglio printing press, at least as far the operation of the wiping unit 10 is concerned.

It has been mentioned hereinabove that it might be desirable to pre-process some of the signals outputted by the sensors that are used to monitor the behaviour of the printing press. This is particular true in connection with the sensing of noises and/or vibrations produced by the printing press, which signals typically exhibit a great number of frequency components. The classical approach to processing of such signals is to perform a spectral transformation of the signals. The usual spectral transformation is the well-known Fourier transform (and derivatives thereof) which converts the signals from the time-domain into the frequency-domain. Processing of the signals is made simpler by working in the thus obtained spectrum as periodic signal components are readily identifiable in the frequency-domain as peaks in the spectrum. The drawbacks of the Fourier transform however reside in its inability to efficiently identify and isolate phase movements, shifts, drifts, echoes, noise, etc., in the signals.

A more adequate "spectral" analysis is the so-called "cepstrum" analysis. "Cepstrum" is an anagram of "spectrum" and is the accepted terminology for the inverse Fourier transform of the logarithm of the spectrum of a signal. Cepstrum analysis is in particular used for analysing "sounds" instead of analysing frequencies. The cepstrum can be seen as information about the rate of change in the different spectrum bands. It was originally proposed for characterizing the seismic echoes resulting from earthquakes and bomb explosions (see paper entitled "The Quefrency Analysis of Time Series for Echoes: Cepstrum, Pseudautocovariance, Cross-Cepstrum, and Saphe Cracking" of Bogert, Healy and Tukey, 1963). Bogert et al. observed that the logarithm of the power spectrum of a signal containing an echo has an additive periodic component due to the echo, and thus the Fourier transform of the logarithm of the power spectrum should exhibit a peak at the echo delay. They called this function "cepstrum", interchanging the letters in the word "spectrum" because "in general, we find ourselves operating on the frequency side in ways customary on the time side and vice versa". The transformation of a signal into its cepstrum is a homomorphic transform, and the concept of the cepstrum is a fundamental part of the theory of homomorphic systems for processing signals that have been combined by convolution (see "Discrete-Time Signal Processing", A. V. Oppenheim and R. W. Schafer, Prentice Hall, Englewood Cliffs, N.J., 1989).

The advantages of cepstrum analysis are multiple:

- one of its most powerful attributes is the fact that any periodicities or repeated patterns in a spectrum will be sensed as one or two specific components in the cepstrum;
- if a spectrum contains several sets of sidebands or harmonic series, they can be confusing because of the overlap. However, in the cepstrum, they are separated in a way similar to the way the spectrum separates repetitive patterns in the time signals;
- cepstrum analysis is particularly suited for the analysis of rotating elements bearing vibrations.

Accordingly, as a preferred embodiment of the invention, the signals measured at rotating elements of the printing press (e.g. noises and/or vibrations produced at the bearings of the wiping cylinder and sensed by acoustic/vibration sensors as mentioned above) are pre-processed using the above-mentioned cepstrum analysis.

Figure 6:
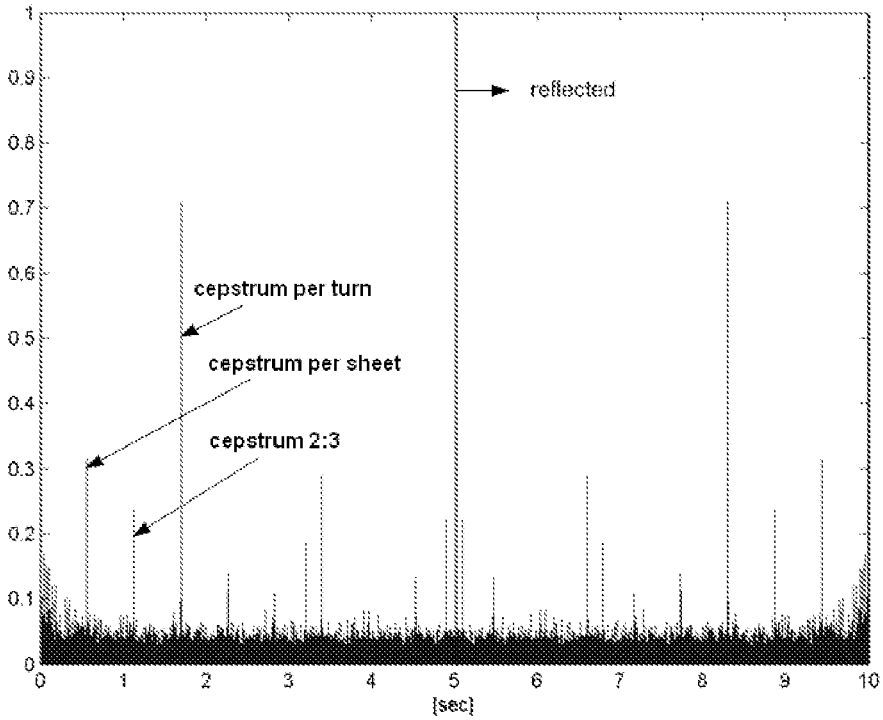
FIG. 6 is an exemplary illustration of a so-called cepstrum obtained by processing signals measured on one bearing of the wiping cylinder.

Referring again to the measurements made on the bearings of the wiping cylinder 10.2 of the intaglio printing press of FIGS. 1 and 2, cepstrum analysis is preferably performed with a view to extract three variables which will be called the "cepstrum per sheet", the "cepstrum 2:3" and the "cepstrum per turn" values, and a trend analysis is performed based on these two variables. The "cepstrum per sheet" value is defined within the scope of the present invention as the value of the cepstrum corresponding to the sheet interval, i.e. the interval of time between two successive sheets. The "cepstrum 2:3" value is defined within the scope of the present invention as the cepstrum value corresponding to the permutation interval of the plate cylinder 8 and Orlof cylinder 9.5 (which are respectively three-segment and two-segment cylinders in this example). The "cepstrum per turn" value, on the other hand, is defined within the scope of the present invention as the cepstrum value corresponding to the interval of time (or turn interval) necessary for the plate cylinder of the printing press to make one complete revolution (which interval of time is a multiple of the sheet interval). In the context of the intaglio printing plate illustrated in FIGS. 1 and 2, which comprises a three-segment plate cylinder and a two-segment Orlof cylinder, the sheet interval, the permutation interval and turn interval (in seconds) will be given by the following formulas:

sheet_interval [s]=3600/sheet-processing_speed [sheets/h], permutation_interval [s]=sheet_interval [s]*#_segments_Orlof_cylinder turn_interval [s]=sheet_interval [s]*#_segments-_plate_cylinder FIG. 6 schematically illustrates an exemplary cepstrum of a noise signal measured at one bearing of the wiping cylinder 10.2, the sheet processing speed of the intaglio printing press being set at 6316 sheets per hour in this example which gives a sheet interval of 0.57 seconds, a permutation interval of 1.14 seconds and a turn interval of 1.71 seconds, the corresponding "cepstrum per sheet", "cepstrum 2:3" and "cepstrum per turn" values appearing as three peaks in the cepstrum of FIG. 6.

Figure 7:
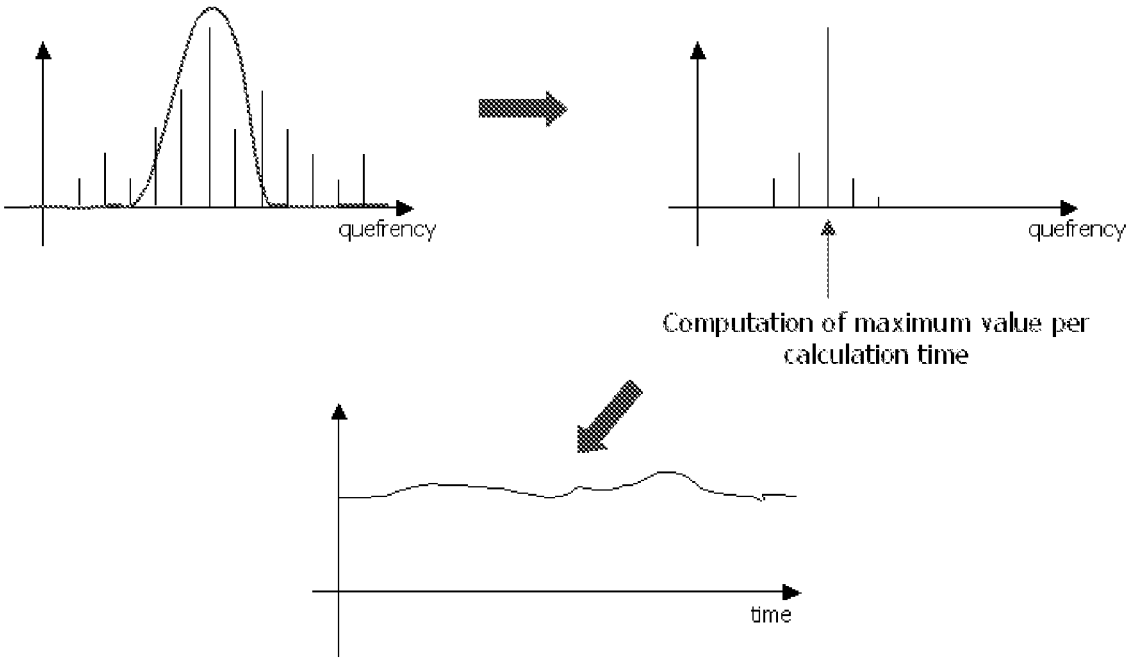
FIG. 7 is a diagram showing schematically how the cepstrum of FIG. 6 might be further processed in order to extract a processed signal corresponding to the evolution over time of the amplitude of selected values of the cepstrum, namely a "cepstrum per sheet" value and a "cepstrum per turn" value as illustrated in FIG. 6.

The evolution (or trend) of each of the "cepstrum per sheet" and "cepstrum per turn" values is preferably monitored using a speed-normalized moving band-pass filter for filtering the relevant band in the cepstrum, which band-pass filter is "locked" onto the relevant sheet interval or turn interval, respectively (which intervals are inversely proportional to the sheet processing speed). The maximum value of the resulting filtered signal is detected and the resulting amplitude over time is recorded. FIG. 7 schematically illustrates the above-mentioned processing and filtering principle. As shown in the upper-left part of FIG. 7, the cepstrum is first filtered around the relevant interval of time (i.e. the sheet interval or the turn interval) using an appropriate speed-normalized band-pass filter (i.e. a band-pass filter which is locked at its centre onto the relevant time interval). The resulting filtered band of the cepstrum is shown on the upper-right part of FIG. 7. The maximum value of this filtered band is detected and the amplitude of which is recorded over time resulting in the signal shown in the lower part of FIG. 7. This signal is then used as a basis for monitoring the trend of the behaviour of the printing press.

Referring again to the acoustic and/or vibrations measurements mentioned hereinabove in reference to FIGS. 5A and 5B, which represent four distinct measurement channels (i.e. horizontal and vertical measurements performed at both sides of the wiping cylinder), cepstrum analysis as described above is performed for each of the four measurement channels and the resulting eight trend signals are used as a basis for monitoring the behaviour of the printing press.

According to a preferred embodiment of the invention, the in-line analysis of the behaviour of the printing press is coupled with in-line inspection of the printed substrates. In other words, the conclusions drawn following pattern classification of the behaviour of the printing press are correlated with those drawn following optical inspection of the printed substrates.

In some instances, the sensed operational parameters might be so characterizing of a faulty or abnormal behaviour of the printing press that it is possible to immediately draw conclusions that the detected faulty or abnormal behaviour will lead to printing errors, without resorting to an optical inspection of the printed substrates. In other instances, however, definite conclusions regarding the likely occurrence of printing errors might not be drawn directly and exclusively from the results of the pattern classification of the printing press behaviour. In such instances coupling of the behaviour analysis with an optical inspection of the printed substrates can help.

Seen from a general point of view, coupling between the analysis of the behaviour of the printing press and inspection of the printed substrates can be performed with a view to:

- issue an early warning of the likely occurrence of printing errors upon determination of a faulty or abnormal behaviour of the printing press while images acquired by the inspection system are still determined to be devoid of printing errors; and/or
- provide an indication of the likely cause of the occurrence of printing errors detected by optical inspection of the printed substrates.

Fuzzy logic techniques are again of use in connection with the coupling of results from inspection of the printed substrates and results from the analysis of the behaviour of the printing press. Through comparison of sensor data representative of characteristic faulty/abnormal behaviours of the printing press and image data of the resulting optical representation of the printing errors, fuzzy sets can be defined and a higher-rank pattern classifier constructed (in a manner similar to that already explained hereinabove in connection with the pattern classification of the behaviour of the printing press).

It will be understood that various modifications and/or improvements obvious to the person skilled in the art can be made to the embodiments described hereinabove without departing from the scope of the invention defined by the annexed claims.

For instance, while cepstrum analysis was described hereinabove as particularly suited to pre-processing of noise-related or vibrations-related measurement signals, spectral analysis using other types of spectral transform might be envisaged. In that context, any suitable derivative of the Fourier transform shall be considered. This includes for instance so-called circular transform and wavelet transform.

In addition, while fuzzy logic techniques have been discussed in connection with the modelling and pattern classification issues, other approaches might be envisaged including modelling techniques making use of so-called neural networks. One difference between the two methods is that a fuzzy pattern classifier can be set up by a learning process and a skilled designer (the so-called "expert") based on experimental data and knowledge of the involved processes, whereas neural networks are based on learning processes only. The expert is able to tune the system with the help of "linguistic modifiers".

The invention claimed is:

1. A method for detection of occurrence of printing errors on printed substrates during processing thereof on a printing press, the method comprising:

providing multiple sensors on functional components of the printing press to sense and monitor a behaviour of the printing press during processing of the printed substrates, which multiple sensors are designed to sense operational parameters of the functional components of the printing press, which operational parameters are representative of the behaviour of the printing press during processing of the printed substrates; and performing an in-line analysis of the behaviour of the printing press, apart from an in-line optical inspection of the printed substrates, to determine occurrence of a characteristic behaviour of the printing press which leads or is likely to lead to occurrence of printing errors on the printed substrates or which leads or is likely to lead to good printing quality of the printed substrates, wherein said in-line analysis of the behaviour of the printing press comprises:

($a_0$) modelling characteristic behaviours of the printing press using the operational parameters of the functional components of the printing press as representative parameters of said characteristic behaviours, said characteristic behaviours comprising:

faulty or abnormal behaviours of the printing press that lead or are likely to lead to the occurrence of printing errors; and/or normal behaviours of the printing press that lead or are likely to lead to good printing quality of the printed substrates, ($a_1$) sensing the operational parameters of the functional components of the printing press during processing of the printed substrates on the printing press; and ($a_2$) determining whether the sensed operational parameters of the functional components of the printing press are indicative of a faulty or abnormal behaviour of the printing press which is likely to lead to printing errors, wherein said determination step ($a_2$) comprises:

($a_{21}$) monitoring the operational parameters of the functional components of the printing press during processing of the printed substrates on the printing press; and ($a_{22}$) determining whether the monitored operational parameters are indicative of any one of the modelled characteristic behaviours of the printing press.

2. The method according to claim 1, wherein said in-line analysis of the behaviour of the printing press includes performing a trend analysis of the behaviour of the printing press during processing of several successive printed substrates.

3. The method according to claim 1, wherein said in-line analysis of the behaviour of the printing press includes performing fuzzy pattern classification of the behaviour of the printing press.

4. The method according to claim 1, further comprising coupling the in-line analysis of the behaviour of the printing press with an in-line optical inspection of the printed substrates.

5. The method according to claim 4, wherein said in-line optical inspection of the printed substrates includes:

(i) optically acquiring images of the printed substrates processed on the printing press; and (ii) processing the acquired images of the printed substrates in order to identify possible occurrence of printing errors on said printed substrates, and wherein said in-line analysis of the behaviour of the printing press is coupled to said in-line optical inspection of the printed substrates in such a way as to issue an early warning of the likely occurrence of printing errors upon determination of a faulty or abnormal behaviour of the printing press while the acquired images are still determined to be devoid of printing errors.

6. The method according to claim 4, wherein said in-line optical inspection of the printed substrates includes:

(i) optically acquiring images of the printed substrates processed on the printing press; and (ii) processing the acquired images of the printed substrates in order to identify possible occurrence of printing errors on said printed substrates, and wherein said in-line analysis of the behaviour of the printing press is coupled to said in-line optical inspection of the printed substrates in such a way as to provide an indication of the likely cause of the occurrence of the printing errors detected by optical inspection of the printed substrates.

7. The method according to claim 1, wherein said modelling step ($a_0$) includes modelling faulty or abnormal behaviours of the printing press that lead or are likely to lead to the occurrence of printing errors and comprises:

($a_{01}$) defining a plurality of classes of printing errors that may occur on the said printing press;

($a_{02}$) for each class of printing errors, determining the operational parameters of the printing press that characterize a faulty or abnormal behaviour of the printing press leading or likely to lead to the occurrence of the printing errors; and ($a_{03}$) for each class of printing errors, defining a corresponding model of the faulty or abnormal behaviour of the printing press based on the operational parameters that are determined to be characterizing of the said faulty or abnormal behaviour, and wherein said determination step ($a_{22}$) includes determining whether the monitored operational parameters show a correspondence with any one of the models of the faulty or abnormal behaviours of the printing press defined at step ($a_{03}$).

8. The method according to claim 1, wherein said modelling of characteristic behaviours of the printing press includes modelling of the said characteristic behaviours by means of sets of fuzzy logic rules.

9. The method according to claim 1, wherein sensors are provided on the printing press in order to sense any combination of operational parameters comprising:

processing speed of the printing press;

rotational speed of a cylinder or roller of the printing press;

current drawn by an electric motor driving cylinders of the printing press;

temperature of a cylinder or roller of the printing press;

pressure between two cylinders or rollers of the printing press;

constraints on bearings of a cylinder or roller of the printing press;

consumption of inks or fluids in the printing press; and/or position or presence of the processed substrates in the printing press.

10. The method according to claim 1, wherein the sensors are provided on the printing press so as to sense operational parameters of the functional components of the printing press that are as much uncorrelated to each other as possible.

11. The method according to claim 1, carried out on an intaglio printing press comprising at least an impression cylinder, a plate cylinder contacting the impression cylinder, an inking system for inking the surface of the plate cylinder, and a wiping unit for wiping the inked surface of the plate cylinder prior to printing.

12. The method according to claim 11, wherein the sensors are provided on the intaglio printing press in order to sense any combination of operational parameters comprising:

processing speed of the intaglio printing press;

current drawn by an electrical motor used as driving means of the intaglio printing press;

rotational speed of the impression cylinder, of the plate cylinder and/or of a cylinder or roller of the inking system or wiping unit;

temperature of the impression cylinder, of the plate cylinder and/or of a cylinder or roller of the inking system or wiping unit;

printing pressure between the plate cylinder and the impression cylinder, wiping pressure between the plate cylinder and the wiping unit;

contact pressure between the plate cylinder and the inking system;

operational parameters of the wiping unit; and/or operational parameters of the inking system.

13. The method according to claim 11, carried out to detect printing errors on the printed substrates which are due to dysfunction in the operation of the wiping unit.

14. The method according to claim 13, wherein said wiping unit includes a wiping tank, a wiping cylinder disposed in the wiping tank and contacting the plate cylinder, a dry blade contacting the surface of the wiping cylinder for removing wiped ink residues from the surface of the wiping cylinder, cleaning means for applying a wiping solution onto the surface of the wiping cylinder, and a drying blade contacting the surface of the wiping cylinder for removing wiping solution residues from the surface of the wiping cylinder, and wherein sensors are provided in order to sense:

wiping pressure between the wiping cylinder and the plate cylinder;

flow of wiping solution in said wiping unit;

physico-chemical properties of the wiping solution;

blade pressure between the dry blade and the wiping cylinder or between the drying blade and the wiping cylinder;

blade position of the dry blade or of the drying blade with respect to the wiping cylinder; and/or constraints on bearings of the wiping cylinder.

15. The method according to claim 14, wherein the wiping pressure, the blade pressure, the blade position and/or the constraints on the bearings of the wiping cylinder is/are sensed at each extremity of the wiping cylinder.

16. The method according to claim 1, wherein monitoring of the behaviour of the printing press includes monitoring noises and/or vibrations generated by said printing press during processing of the printed substrates.

17. The method according to claim 16, wherein the noises and/or vibrations produced by said printing press are sensed on bearings of a cylinder of the printing press.

18. The method according to claim 17, carried out on an intaglio printing press comprising at least an impression cylinder, a plate cylinder contacting the impression cylinder, an inking system for inking the surface of the plate cylinder, and a wiping unit with a wiping cylinder contacting the plate cylinder for wiping the inked surface of the plate cylinder prior to printing, wherein the noises and/or vibrations produced by said intaglio printing press are sensed on the bearings of said wiping cylinder.

19. The method according to claim 17, wherein the noises or vibrations produced by said printing press are sensed by at least two sensors placed on bearings of the cylinder and which are sensitive to the noises or vibrations transmitted along at least two distinct directions perpendicular to an axis of rotation of the cylinder.

20. The method according to claim 17, wherein the noises or vibrations produced by said printing press are sensed by acoustic sensors, acceleration sensors or pressure-sensitive sensors.

21. The method according to claim 1, further including pre-processing of signals outputted by the sensors.

22. The method according to claim 21, wherein said pre-processing of the signals outputted by the sensors includes performing a so-called cepstrum analysis of the said signals.

23. An expert system for detection of occurrence of printing errors on printed substrates during processing thereof on a printing press, said expert system comprising multiple sensors coupled to functional components of the printing press for monitoring a behaviour of the printing press during processing of the printed substrates, and a processing system coupled to said sensors for performing an in-line analysis of the behaviour of the printing press, said processing system being adapted to carry out the method according to claim 1.

24. A printing press equipped with an expert system as claimed in claim 23.

25. A method for detection of occurrence of printing errors on printed substrates during processing thereof on a printing press, the method comprising:

providing multiple sensors on functional components of the printing press to sense and monitor a behaviour of the printing press during processing of the printed substrates, which multiple sensors are designed to sense operational parameters of the functional components of the printing press, which operational parameters are representative of the behaviour of the printing press during processing of the printed substrates; and performing an in-line analysis of the behaviour of the printing press, apart from an in-line optical inspection of the printed substrates, to determine occurrence of a characteristic behaviour of the printing press which leads or is likely to lead to occurrence of printing errors on the printed substrates or which leads or is likely to lead to good printing quality of the printed substrates, wherein monitoring of the behaviour of the printing press includes monitoring noises and/or vibrations generated by said printing press during processing of the printed substrates, wherein the noises and/or vibrations produced by said printing press are sensed on bearings of a cylinder of the printing press, and wherein the noises or vibrations produced by said printing press are sensed by at least two sensors placed on bearings of the cylinder and which are sensitive to the noises or vibrations transmitted along at least two distinct directions perpendicular to an axis of rotation of the cylinder.

26. An expert system for detection of occurrence of printing errors on printed substrates during processing thereof on a printing press, said expert system comprising multiple sensors coupled to functional components of the printing press for monitoring a behaviour of the printing press during processing of the printed substrates, and a processing system coupled to said sensors for performing an in-line analysis of the behaviour of the printing press, said processing system being adapted to carry out the method according to claim 25.

27. A printing press equipped with an expert system as claimed in claim 26.

28. A method for detection of occurrence of printing errors on printed substrates during processing thereof on a printing press, the method comprising:

providing multiple sensors on functional components of the printing press to sense and monitor a behaviour of the printing press during processing of the printed substrates, which multiple sensors are designed to sense operational parameters of the functional components of the printing press, which operational parameters are representative of the behaviour of the printing press during processing of the printed substrates; and performing an in-line analysis of the behaviour of the printing press, apart from an in-line optical inspection of the printed substrates, to determine occurrence of a characteristic behaviour of the printing press which leads or is likely to lead to occurrence of printing errors on the printed substrates or which leads or is likely to lead to good printing quality of the printed substrates, wherein the method is carried out on an intaglio printing press comprising at least an impression cylinder, a plate cylinder contacting the impression cylinder, an inking system for inking the surface of the plate cylinder, and a wiping unit for wiping the inked surface of the plate cylinder prior to printing, wherein the method is carried out to detect printing errors on the printed substrates which are due to dysfunction in the operation of the wiping unit, and wherein said wiping unit includes a wiping tank, a wiping cylinder disposed in the wiping tank and contacting the plate cylinder, a dry blade contacting the surface of the wiping cylinder for removing wiped ink residues from the surface of the wiping cylinder, cleaning means for applying a wiping solution onto the surface of the wiping cylinder, and a drying blade contacting the surface of the wiping cylinder for removing wiping solution residues from the surface of the wiping cylinder, and wherein sensors are provided in order to sense:

wiping pressure between the wiping cylinder and the plate cylinder;

flow of wiping solution in said wiping unit;

physico-chemical properties of the wiping solution;

blade pressure between the dry blade and the wiping cylinder or between the drying blade and the wiping cylinder;

blade position of the dry blade or of the drying blade with respect to the wiping cylinder; and/or constraints on bearings of the wiping cylinder.

29. An expert system for detection of occurrence of printing errors on printed substrates during processing thereof on an intaglio printing press, said expert system comprising multiple sensors coupled to functional components of the intaglio printing press for monitoring a behaviour of the intaglio printing press during processing of the printed substrates, and a processing system coupled to said sensors for performing an in-line analysis of the behaviour of the intaglio printing press, said processing system being adapted to carry out the method according to claim 28.

30. An intaglio printing press equipped with an expert system as claimed in claim 29.

* * * * *